US006909872B2

(12) United States Patent
Eskey

(10) Patent No.: US 6,909,872 B2
(45) Date of Patent: Jun. 21, 2005

(54) MULTIPATH PRINTERS

(75) Inventor: Eric Unger Eskey, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/283,570

(22) Filed: Oct. 30, 2002

(65) Prior Publication Data

US 2004/0086310 A1 May 6, 2004

(51) Int. Cl.[7] ..... G03G 15/00
(52) U.S. Cl. ..... 399/401; 399/364; 399/402
(58) Field of Search ..... 399/306, 309, 399/364, 401, 402; 271/301

(56) References Cited

U.S. PATENT DOCUMENTS 4,924,275 A * 5/1990 Nelson ..... 399/401
5,055,885 A * 10/1991 Yoshikado et al. ..... 399/401
5,678,157 A * 10/1997 Yoshida et al.
6,275,676 B1 * 8/2001 Ushio ..... 399/401

* cited by examiner

*Primary Examiner*—Arthur T. Grimley
*Assistant Examiner*—Ryan Gleitz

(57) ABSTRACT

A printer device has first and second print media paths to carry paper from a sheet pickup mechanism to the printer device and then to a sheet exit opening. A third print media path carries the sheet from the sheet exit opening back to the printer device for duplex printing. A sheet diverter has first and second operating positions for allowing the sheet to pass in the first flow direction and for diverting the sheet in a second flow direction toward the printer device. A sheet pickup mechanism has a first operating position for the mechanism to pick up the sheet from a sheet dispensing tray and a second operating position in which the mechanism is part of a duplex printing path when the sheet travels in the second flow direction toward the printer device.

9 Claims, 14 Drawing Sheets

MULTIPATH PRINTERS

BACKGROUND OF THE INVENTION

1. Field of the Invention

The present invention generally relates to office machine printers such as electrophotographic printers, inkjet printers, etc. More particularly, it relates to apparatus and techniques for improving the utility of such printers by providing an expanded array of print media paths therein.

2. Prior Art

Office machine printers such as electrophotographic printers, inkjet printers, etc. very often have both a simplex printing path and a duplex printing path. In the case of simplex printing, a sheet is first taken from a stack of print media (such as a stack of paper) that resides in a sheet dispenser tray located next to, or forming a part of, a printer housing. It is then guided into a first opening in said housing. The sheet receives printing on one side and thereafter leaves the printer as a finished product via a second opening in the printer housing. This second opening is usually serviced by a sheet collection tray.

In the case of duplex printing, a sheet that has received printing on one side is then: (1) temporarily stored in a duplexing tray (that normally resides completely within the printer housing), (2) withdrawn from the duplexing tray, (3) turned over within the printer housing, (4) subjected to printing on its second side and then (5) sent to the sheet collection tray via the same second opening used in the simplex printing operation.

Thus, for example, an electrophotographic printing process might generally comprise the steps of (1) withdrawing a sheet of paper from a stack of such paper residing in a sheet dispenser tray, (2) placing said sheet in a print media path in the printer, (3) using a light emitting source such as a laser beam to form an electrical latent image on a charged photoconductor drum, (4) developing that latent image with a toner, (5) transferring the resultant toner image onto the sheet of paper, (6) fusing the toner image to the sheet (by means of heat, pressure, etc.) and then (7) sending that sheet directly to the sheet collection tray (simplex printing), or (8) sending the sheet to a duplexing tray (duplex printing) located within the printer, (9) removing the sheet from the duplexing tray, (10) turning the sheet over, (11) printing on its second side, (12) directing said sheet through a fuser and then (13) sending said sheet to the sheet collection tray.

SUMMARY OF THE INVENTION

This invention is concerned with printers having a plurality of print media paths. A plurality of print media paths enables a printer to carry out simplex and/or duplex printing operations. In the printers of this patent disclosure, a first print media path carries a given sheet of print media from a sheet pickup mechanism to a printer device (e.g., to an electrophotographic printer, to an inkjet printer, etc.). A second print media path carries the sheet from the printer device to a sheet exit opening. A third print media path carries a given sheet back through the sheet exit opening and then to the printer device as part of a duplex printing operation.

A housing for applicant's printer has (1) at least one sheet entry opening through which a sheet can be delivered to the first print media path and (2) at least one sheet exit opening through which the sheet can be (a) dispensed from the housing after said sheet travels, in a first flow direction, past the printer device and past a sheet diverter, (b) pulled, in a second flow direction, back through the sheet exit opening so that it can be sent back to the printer device as part of a duplex printing operation.

Applicant's printer also has a sheet diverter and a sheet pickup mechanism. The sheet diverter has a first operating position for allowing a sheet to pass, in the first flow direction, and a second operating position for diverting a given sheet, while said sheet travels in a second flow direction, back toward the printer device as part of a duplex printing operation. In one embodiment of applicant's invention, the sheet path diverter operates from a first operating position when a sheet is moving past the diverter in a first flow direction (i.e., forward, toward the sheet exit opening) and operates from a second operating position when that same sheet is moving past the diverter in a second, backward flow direction leading back to the printer. The sheet pickup mechanism has a first operating position wherein said mechanism picks up a given sheet from a sheet dispensing tray, and a second operating position wherein said mechanism serves as a part of the third print media path that sends a sheet back to the printer as part of a duplex printing operation.

BRIEF DESCRIPTION OF THE DRAWINGS

FIG. 1(*b*) is a cross section view of the embodiment of the printer of FIG. 1(*a*) wherein the sheet is shown passing through a fuser, over a sheet diverter (in a first operating position) and out of a sheet exit opening.

FIG. 1(*c*) is a perspective view of a sheet pickup/transport device in the form of a belt looped around two rollers.

FIG. 1(*d*) is a side view of the sheet pickup/transport device shown in FIG. 1(*c*).

FIG. 1(*e*) is a perspective view of a multiple-roller device that also can be used as a sheet pickup/transport device in the practice of this invention.

FIG. 1(*f*) is a cross section view of the embodiment of the multiple-roller device shown in FIG. 1(*e*).

FIG. 2(*b*) is a cross section view of the embodiment of the printer of FIG. 2(*a*) wherein the sheet has moved in a backward direction, collided with a sheet directing surface of the sheet diverter (as a result of said diverter being in its second operating position) and directed into contact with a sheet pickup mechanism.

FIG. 2(*c*) depicts the embodiment of the printer of FIG. 2(*b*) in an operating position wherein the sheet is passing over the sheet pickup mechanism and over a portion of the first forwardly moving sheet transport path leading from the sheet dispensing tray to the printer.

FIG. 3(*b*) shows the sheet depicted in FIG. 3(*a*) passing over the diverter (in its first operating position) and exiting the printer via a sheet exit opening.

FIG. 4(*b*) shows the printer of FIG. 4(*a*) wherein the sheet shown in FIG. 4(*a*) is passing over the first forward moving sheet transport path of said printer that generally leads from the sheet dispenser tray to the printer.

FIG. 4(*c*) shows the printer of FIG. 4(*b*) wherein the sheet is passing through the printer, fuser and out of the sheet exit opening.

FIG. 5(*b*) shows the embodiment of the printer of FIG. 5(*a*) wherein the sheet is shown passing through the printer and fuser via the second forwardly moving sheet transport path.

FIG. 5(*c*) shows the embodiment of the printer of FIG. 5(*b*) wherein the sheet is shown leaving the printer via the sheet exit opening.

DETAILED DESCRIPTION OF THE INVENTION

Figure 1A:
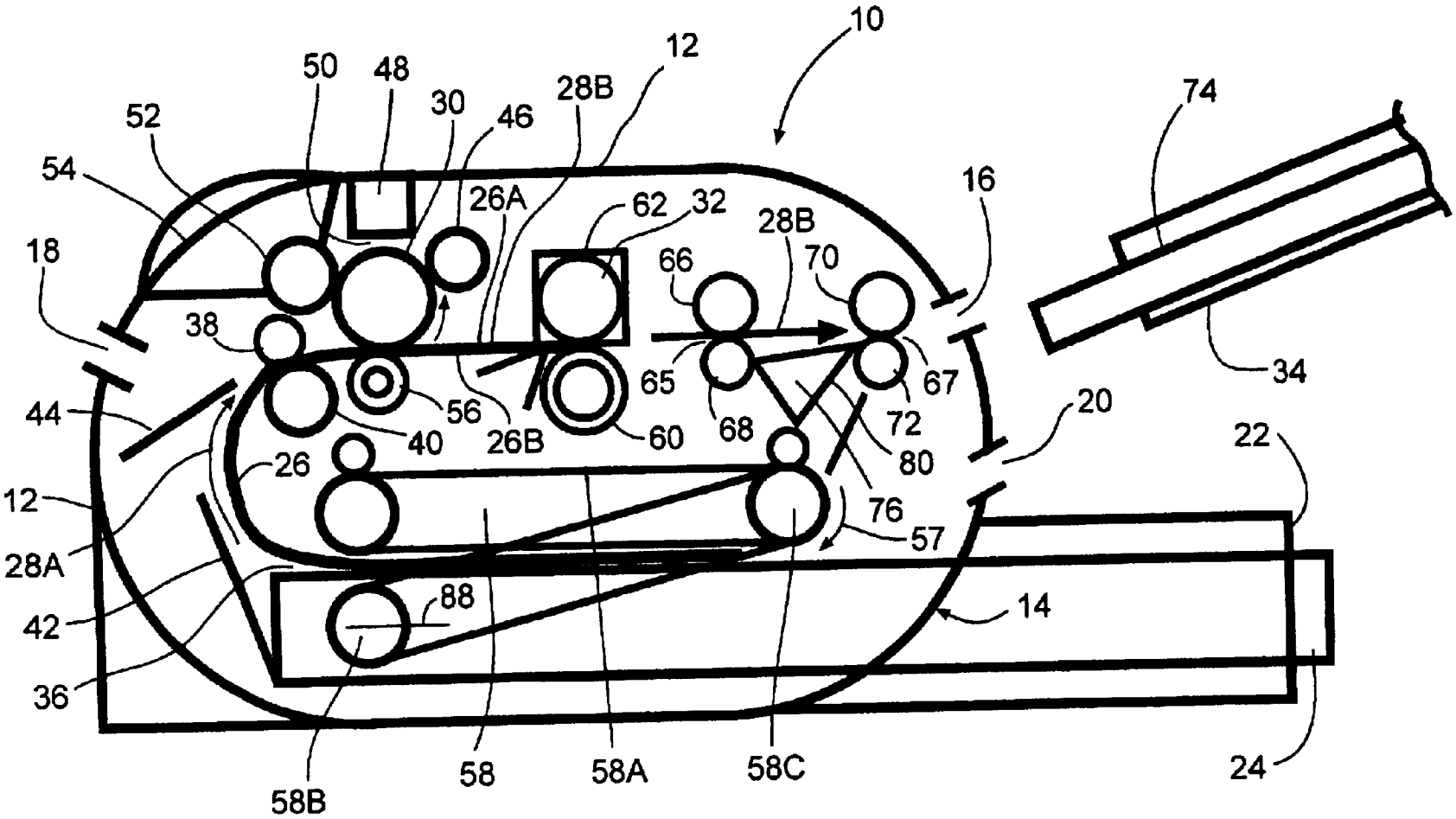
FIG. 1(*a*) is a cross section view of an embodiment of a printer having four print media entry and/or exit openings and wherein an individual sheet is shown being withdrawn from a sheet dispensing tray and delivered (via a first forwardly moving sheet transport path) to a printer mechanism.
Figure 1B:
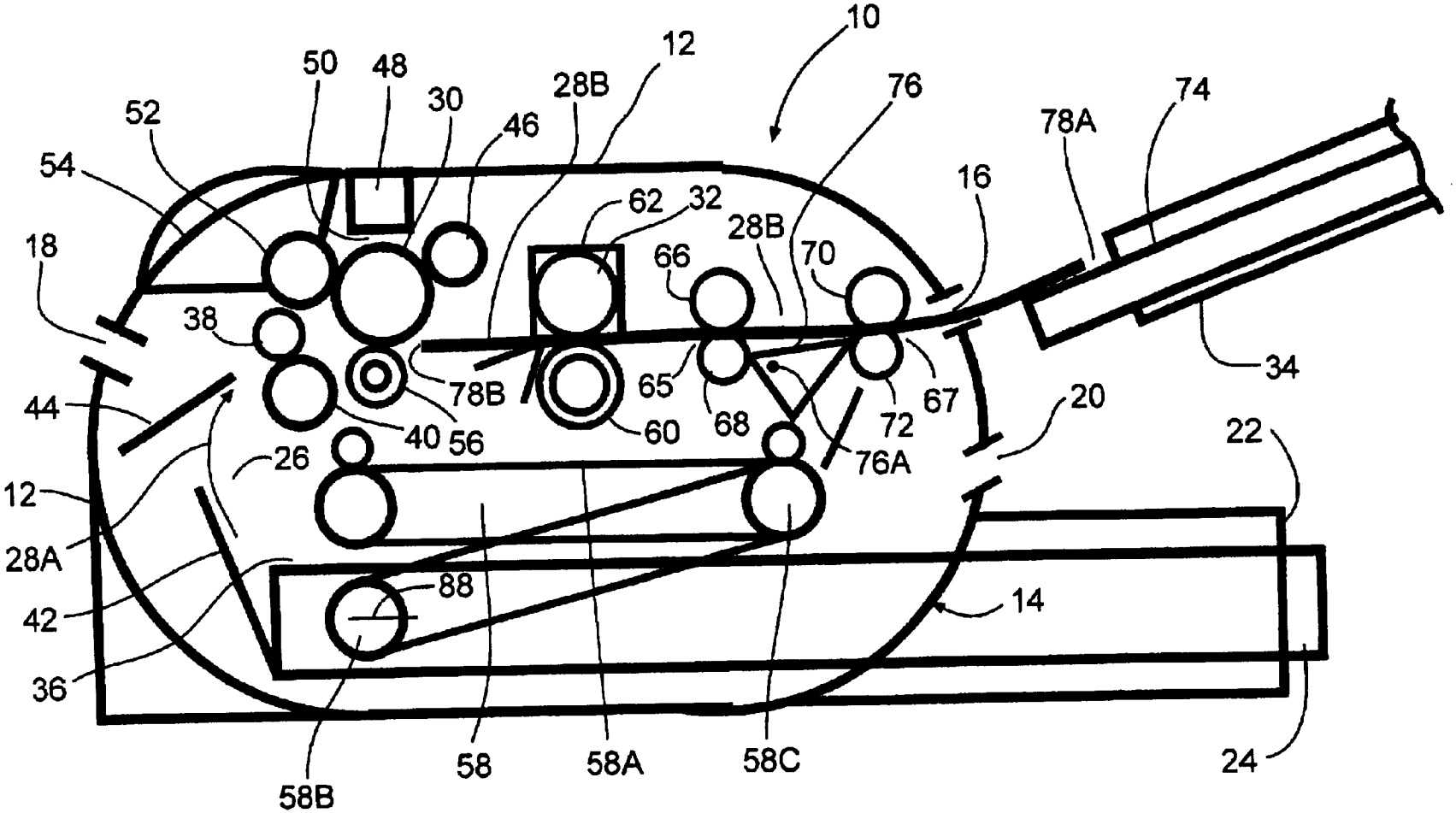
Figure 1C:
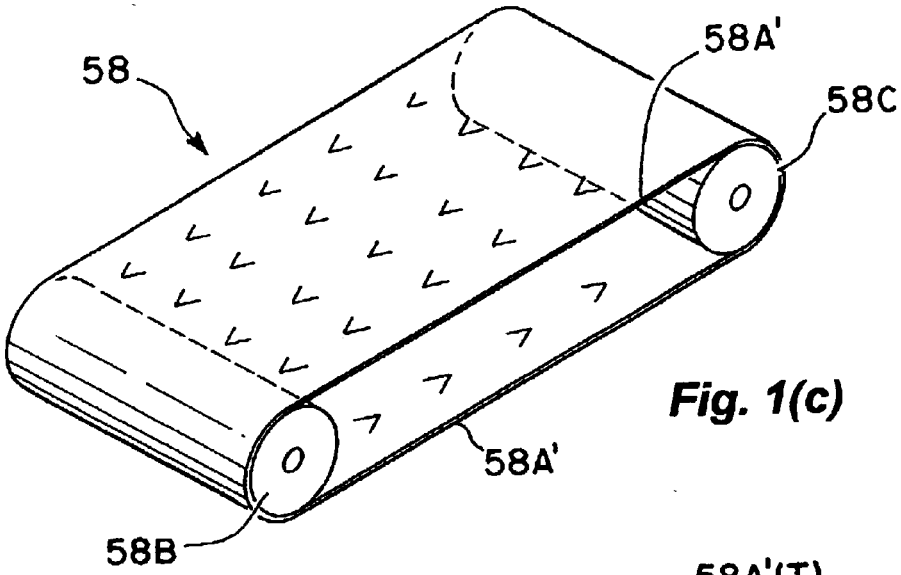
Figure 1D:
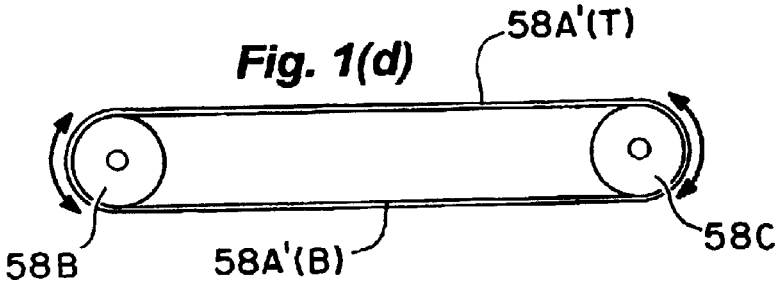
Figure 1E:
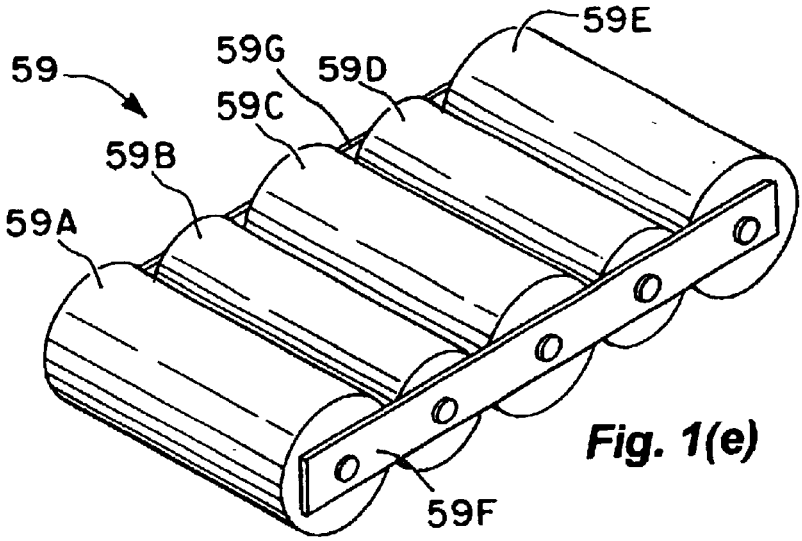
Figure 1F:
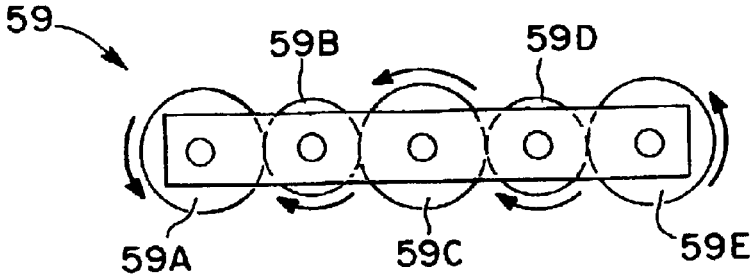

FIG. 1(*a*) shows a cross section view of a multipath, electrophotographic printer 10 that is generally constructed according one embodiment of this invention. This particular electrophotographic printer 10 has an external housing 12 that has at least three and preferably four sheet entry and/or exit openings e.g., openings 14, 16, 18 and 20 through which sheets of print media can be introduced into, or taken from, the printer 10. The printer 10 is shown provided with a sheet dispensing tray 22 in which a stack 24 of sheets of print media rests. A representative top sheet 26 of this stack 24 is shown being removed from said stack.

This representative top sheet 26 (having a top surface 26A and a bottom surface 26B) is shown being guided over a first forwardly moving sheet transport path 28A that forms a first part of an overall print media path through the printer 10. This overall print media path is comprised of the first forwardly moving sheet transport path 28A (i.e., the first part of the print media path) and a second forwardly moving sheet transport path 28B (i.e., the second part of the print media path). The first part 28A of the overall media path generally extends from the front of the stack of sheets 24 to a printer device 30 such as a photoconductor drum. The second part 28B of the overall media path generally extends from the printer device 30, to a fuser 32 and then to a sheet exit opening 16. The exit opening can be serviced by a sheet collection tray. The first part 28A of the overall media path also may be thought of as extending from the upper front region 36 of a representative top sheet 26 in the print media stack 24 to the printing device 30, preferably via a first, powered, guide roller system 38/40. Travel of a given top sheet 26 over this first part 28A of the overall media path also can be facilitated by use of sheet transport and/or guide devices 42, 44, etc. well known to the office machine printer arts. Generally speaking, such a sheet 26 travels upward from the upper front region 36 of a given top sheet 26 of print media to the guide roller system 38/40. Thereafter, the sheet travels over the second part 28B of the overall media path (i.e., over media paths 28A and 28B) in a generally forward direction (e.g., from left to right) through the fuser 32 and on toward sheet collection tray 34.

The electrophotographic printer 10 shown in FIG. 1(*a*) is shown provided with a printer device 30, e.g., in the form of a photoconductor drum upon which a latent electrostatic image is placed, and thereafter removed (by methods well known to the electrophotographic printing arts). For example, a charge roller 46 can be used to charge the surface of the photoconductor drum 30 to a predetermined voltage. A light-emitting device such as a laser scanner 48, a LED array that emits a light beam 50 which is pulsed on and off as it is swept across the surface of the photoconductor drum 30 and thereby discharging select portions of the surface of the photoconductor drum 30 according to a computer program. The resulting selectively discharged portions of the surface of the photoconductor drum 30 constitute a latent electrostatic image. The drum 30 rotates (e.g., in the counterclockwise direction suggested by the arrow) into a rolling relationship with a developer roller.

In the case of an electrophotographic printer, such a developer roller 52 is used to develop the latent electrostatic image in those places where the surface of the photoconductor drum 30 has been selectively discharged by the laser beam scanner 48. In order to do this, charged toner particles having magnetic properties, stored in an electrophotographic toner print cartridge 54, are moved from said cartridge to the developer roller 52. For example, a magnet (not shown) located within the developer roller 52 can be used to magnetically attract charged toner particles to the surface of said developer roller. As the developer roller 52 rotates, the charged toner particles on the surface of the developer roller 52 are electrostatically drawn across a gap between the developer roller and the surface of the photoconductor drum 30 and thereby developing the latent electrostatic image in those areas of the drum 30 that were not discharged by the laser scanner 48. This developed image is then ready to be transferred to a print medium such as a sheet of paper.

In order to accomplish such a drum 30 to print medium 26 toner transfer, a given sheet of print media passes between a toner transfer roller 56 and the photoconductor drum 30. Thus, a vertical region (not shown) between the bottom of the drum 30 and the top of the transfer roller 56 may be regarded as a vertical, toner transfer zone. The transfer roller 56 electrostatically attracts toner particles away from the photoconductor drum 30 and onto the top surface 26A of the sheet of print media 26. In a simplex printing operation, the bottom surface 26B of the sheet 26 does not receive printing. Upon completion of such a simplex printing operation, the sheet is sent through the fuser 32 and then to the sheet collection tray 34 via the sheet exit opening 16.

Individual top sheets 26 of the print media are successively unloaded from the print media dispensing tray 22 by a sheet pickup mechanism 58. This sheet pickup mechanism 58 has two operating positions or modes. In its first operating position or mode, this sheet pickup mechanism removes successive "top" sheets 26 from a stack 24 of sheets in the sheet dispensing tray 22 (e.g., by driving successive top sheets into the first portion 28A of the print media path). In its second operating position, the sheet pickup mechanism 58 serves as a part of a print media path over which successive sheets travel in a duplex printing operation hereinafter more fully described.

Such a sheet pickup mechanism 58 can be comprised of an endless belt 58A that loops over a front roller 58B and over a rear roller 58C. One of these rollers is powered. Thus the powered roller (e.g., roller 58C) drives the belt 58A which turns the unpowered roller (e.g., roller 58B). In the sheet pickup mechanism's first operating position, the axle of the front roller 58B is lowered to a lower level 88 so that the belt 58A will come into contact with successive top sheets 26 in the stack 24 of print media. In this first operating position, the rear roller 58C is powered in the clockwise direction suggested by direction arrow 57. By this action, the sheet pickup device 58 drives a given top sheet 26 forward (i.e., leftward) and into the first part 28A of the overall media path. This overall media path may be further defined within the electrophotographic printer 10 by an array of media transporting, handling and guiding devices such as plate guides, powered rollers, belts, and the like. Again, by way of example only, FIG. 1 (*a*) shows the first part of the media path 28A provided with a first guide plate 42 and a second guide plate 44 which serve to guide a given sheet into the first powered guide roller system 38/40. It also should be noted in passing that the sheet 26 depicted in FIG. 1 (*a*) is bent a great deal (e.g., almost 90°) in traveling over the first part 28A of the overall media path. Thus, a sheet 26 traveling over this first part 28A should be a relatively flexible print material such as paper and flexible, plastic media such as overhead transparencies—as opposed to a relatively inflexible print media material such as cardboard and the like.

After a given sheet of print media moves further along the media path (i.e., past the photoconductor drum 30 and the transfer roller 56), the second part 28B of the overall media path delivers the sheet of print-carrying media to a pressure roller/fuser roller device 60/62. The sheet of print media 26 passes between the fuser roller 62 and pressure roller 60 under conditions of both heat and pressure. Preferably, the pressure roller 60 provides a powered, pressured rolling interface relationship between the two rotating roller surfaces. For the sake of visual clarity and simplicity, this system is depicted as being only comprised of a pressure roller 60 and a heater or fuser roller 62. By way of example, the pressure roller 60 is powered, and rolls against (and thereby drives) the heater roller 62. Regardless of which roller is serving as a powered drive roller, the toner image-bearing sheet of print media passes through a rolling interface produced between the two rotating rollers. A heat source, such as an induction heater element or a halogen lamp, can be mounted in a hollow shaft of the fuser roller 62. Thus, a combination of heat from the fuser roller 62 and pressure provided by the presence of the pressure roller 60 serve to fix given a toner image on a given sheet of print media.

Thereafter, a first sheet output roller system 65 nips and pulls a sheet of print media further along the second part 28B of the overall media path. This first sheet output roller system 65 is comprised of a top roller 66 turning in a counterclockwise manner and a bottom roller 68 turning in a clockwise manner. A second output roller system 67 (comprised of a top roller 70 and bottom roller 72) receives the rightwardly moving sheet and deposits it in a sheet collection tray 34. While the sheet is moving from left to right the top roller 70 turns in a counterclockwise direction while the bottom roller turns in a clockwise direction. In a simplex printing operation, these output roller systems 65 and 67 serve to directly deliver a sheet to the sheet exit opening 16 and then to the sheet collection tray 34. The sheet collection tray 34 is shown lying totally outside of the housing in FIG. 1(*a*). The collection tray can be attached to the housing 12 of the printer 10 for correct positioning of said tray and easy manual access to any finished print product residing therein (e.g., a stack of paper 74).

FIG. 1(*b*) also depicts the electrophotographic printer of FIG. 1(*a*) in its first operating position at a point where a representative sheet 26 is passing through (a) the fuser 32, (b) the first sheet output roller system 65, (c) the second sheet output roller system 67, (d) the sheet exit opening 16 and on to the collection tray 34. In this view the forward edge 78A of the forward moving sheet 26 is shown being directed toward the collection tray 34 while the trailing edge 78B is about to pass through the fuser 32. This sheet 26 also can be regarded as passing over the second part 28(B) of the overall print media path. Again, the sheet 26 is depicted as moving in a forward flow direction (i.e., moving from left to right). In so moving, the sheet 26 passes a sheet diverter 76 (e.g., the sheet 26 is shown passing over the top of the diverter without making any colliding contact with it). This sheet diverter 76 is very generally depicted as having a triangular configuration and a pivot device 76A. The triangular configuration is, however, used primarily to illustrate the sheet flow aspects of this invention. For example, in FIG. 1 (*b*) the sheet 26 is shown moving in a forward direction (i.e., left to right) over a top surface of the diverter 76 while said diverter is in a first operating position. This first operating position is achieved by rotating the diverter 76 clockwise about its pivot device 76A. FIG. 1(*b*) shows that while the diverter 76 is in this first operating position, it offers little or no opposition to the forward (rightward) movement of a sheet 26 passing over it. Hence, the sheet 26 can be readily delivered (via sheet exit opening 16) to the sheet collection tray 34. To a large extent, sheet 26 rests on top of the stack of sheets in the sheet collection tray 34.

FIG. 1(*c*) is a perspective view of a representative sheet pickup/transport device 58 used in the multipath printers of this patent disclosure. The device 58 is comprised of a belt 58A' that is looped over two rollers 58B and 58C. The belt 58 is preferably made of an elastomeric material such as rubber, latex and the like. As seen in FIGS. 1(*a*) and 1(*b*) the sheet pickup/transport device 58 has two operating positions. In its second operating position, the device 58 has a substantially horizontal orientation such as that shown in FIG. 1(*d*). While in this orientation a sheet can be transported (e.g., from right to, left) by movement of the top surface 58A'(T) of the belt 58A' (e.g., from right to left) by virtue of rotation of the rollers 58B and 58C in a counterclockwise direction.

Figure 2A:
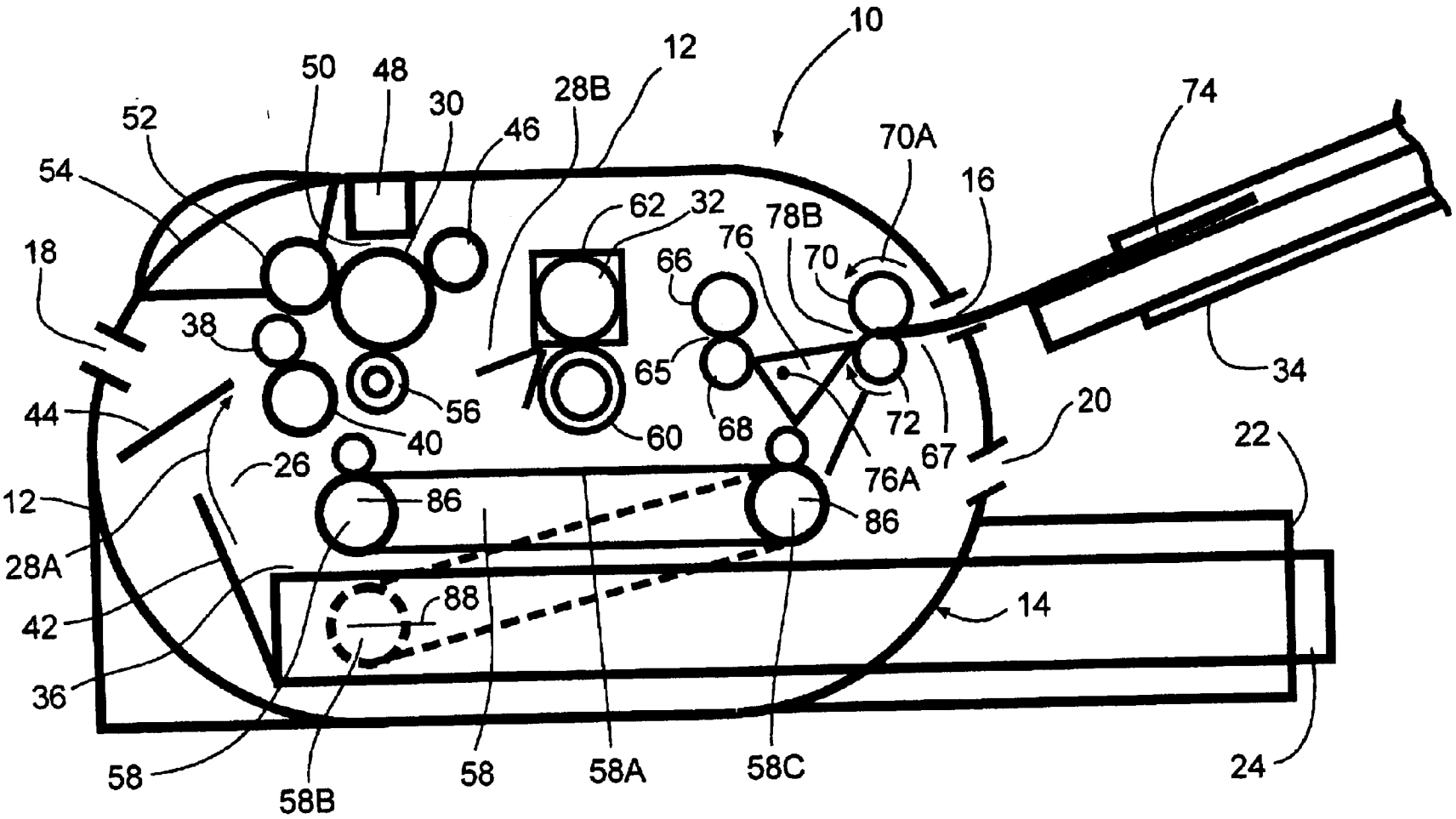
FIG. 2(*a*) is a cross section view of the embodiment of the printer of FIG. 1(*b*) wherein a sheet has reached a full forward position in the sheet exit opening.
Figure 2B:
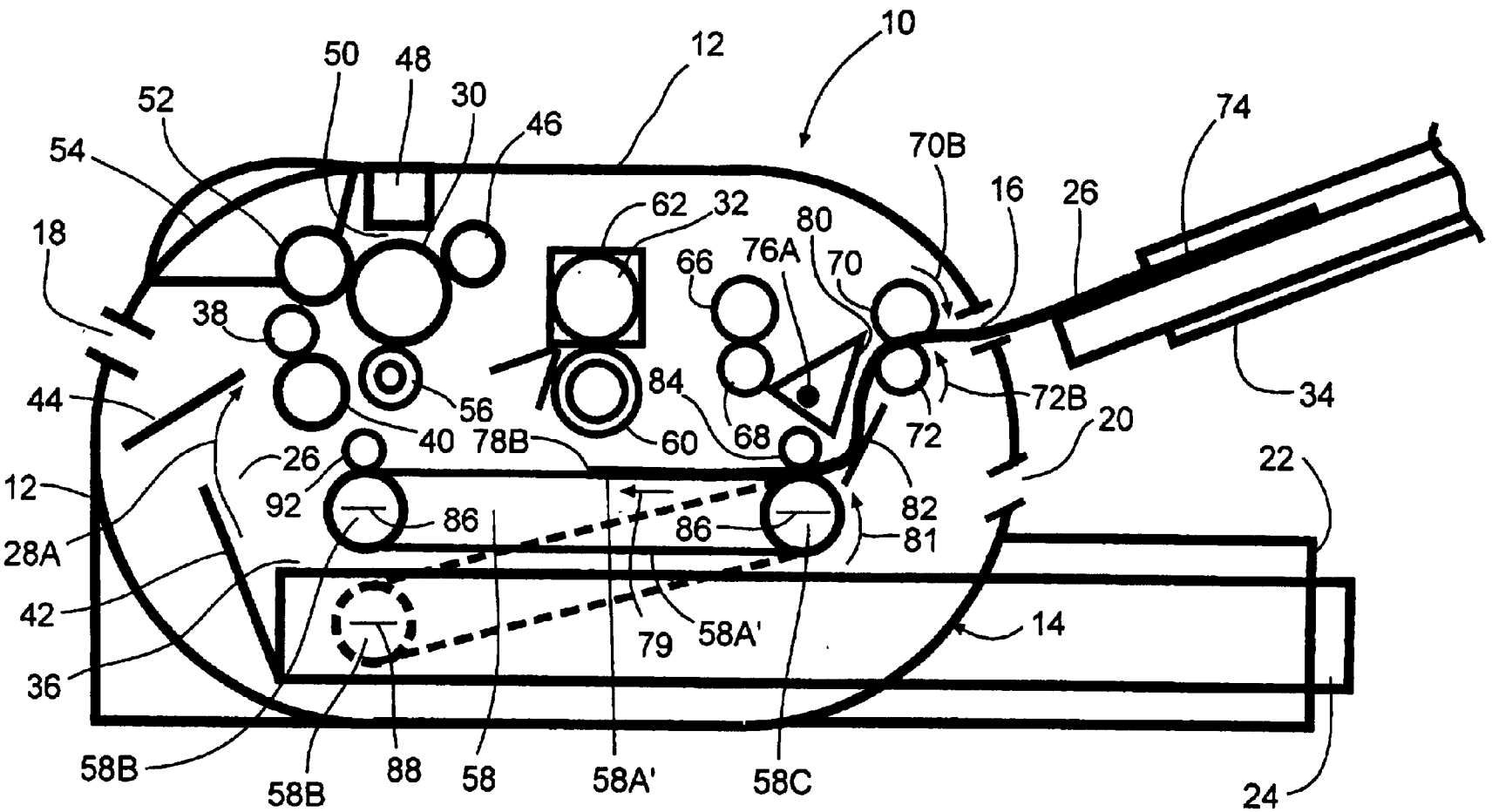
Figure 2C:
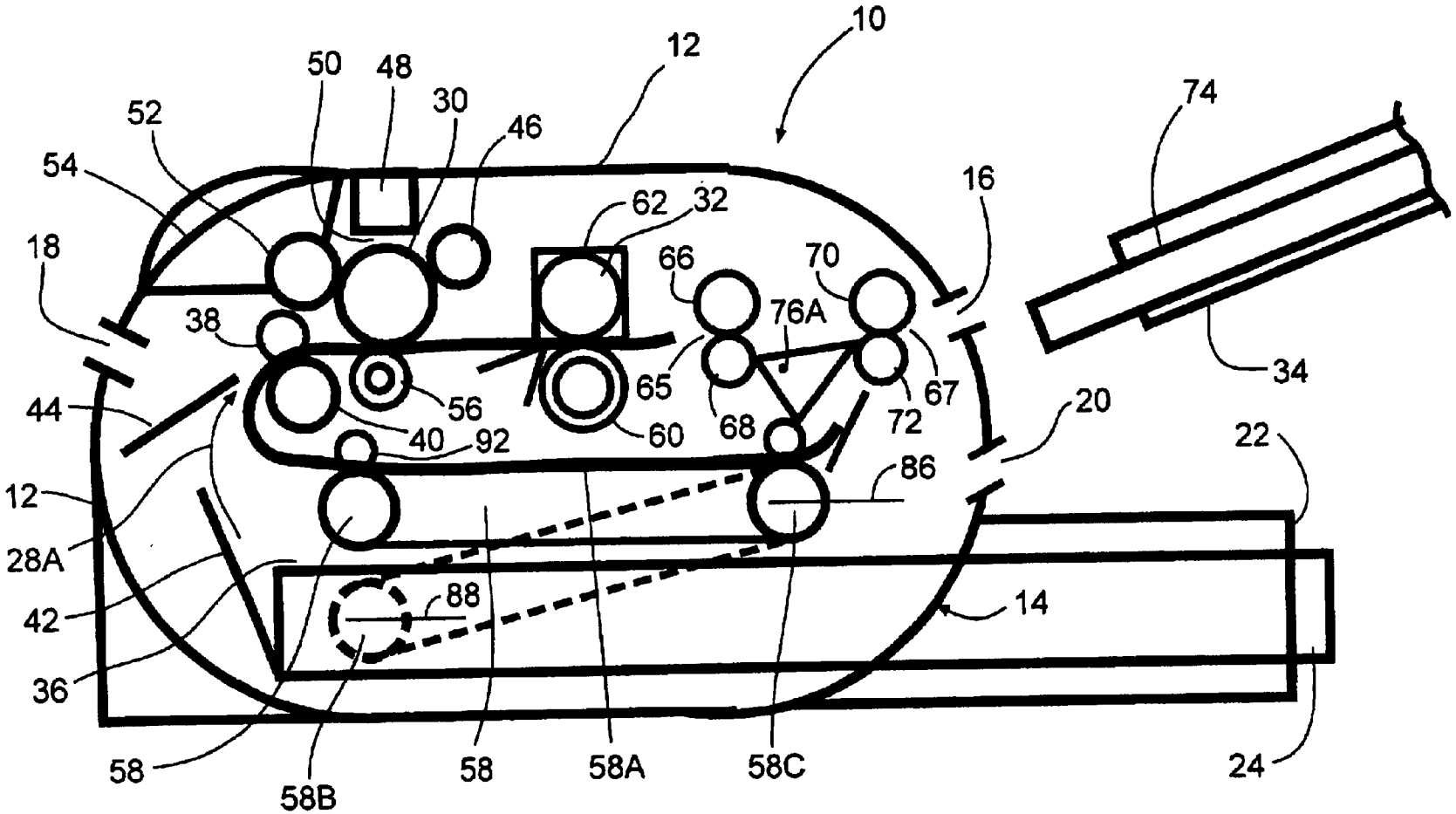

In its first operating position, the sheet pickup/transport device 58 has an inclined orientation such as that depicted by the phantom lines employed in FIG. 2(*b*). That is to say that roller 58B is at a level 88 that is lower than the level 86 of roller 58C. This is the sheet pickup mode of operation of the device 58. In this sheet pickup mode the rollers 58B and 58C are rotated in a clockwise direction so that the bottom surface 58A'(B) of the belt 58A' is moved from right to left. Since the bottom surface 58A'(B) of the belt 58A' also is in physical contact with a top sheet in the sheet stack 24, the top sheet will be forced forward (i.e., from right to left).

FIG. 1(*e*) shows another sheet pickup/transport device 59 suitable for use in the practice of this invention. It is comprised of a series of rollers 59A, 59B . . . 59E respectively rotatably mounted between two mounting bars 59F and 59G. Such a device 59 also has a second, horizontal operating position and a first inclined operating position. The rollers and especially powered outside roller(s) 59A and/or 59E also can be appropriately rotated in either a counterclockwise direction (to perform a sheet transport function) or a clockwise direction (to perform a sheet pickup function).

FIG. 1(*f*) is a cross section view of the multiple-roller sheet pickup/transport device 59 shown in FIG. 1(*e*). By way of example, it depicts rollers 59A and 59E respectively rotating in a counterclockwise direction conducive to transporting a sheet over the top surfaces of the rollers in a right to left direction. FIG. 1 also depicts how some of the rollers (e.g., rollers 59B and 59D) can have smaller diameters than their neighboring rollers 59A, 59C and 59E.

FIG. 2(*a*) shows a point in a first operating mode of the printer 10 wherein a large portion of the sheet 26 has passed through the sheet exit opening 16 and has reached a full forward position (i.e., its full rightward position—but without having completely left the printer housing). To a large extent, sheet 26 rests on top of the stack of sheets in the sheet collection tray 34. It should be specifically noted, however, that the trailing edge 78B of sheet 26 is still in the grip of the second sheet output roller system 67 (rollers 70 and 72) when the sheet achieves this full forward (rightward) position. In this full forward position, the rollers of the output roller system (70 and 70A) have ceased to rotate. That is to say, roller 70 has ceased to rotate in the counterclockwise direction suggested by the arrow 70A associated with roller 70 and roller 72 has ceased to rotate in the clockwise direction suggested by the arrow associated with it. It also should be noted that the sheet diverter 76 has not yet moved to its second operating position (i.e., it has not yet rotated counterclockwise about pivot device 76A).

FIG. 2(*b*) shows the printer operating in a second mode of operation wherein the sheet 26 is traveling in a generally right to left direction depicted by arrow 79. The diverter 76 is in its second operating position in this second mode of operation. This second operating position is brought about by rotating said diverter 76 in a counterclockwise direction about its pivot device 76A. In this second operating position the diverter 76 presents a sheet impeding and directing surface 80 to the trailing edge 78B of the sheet when the sheet starts to move in a backward flow direction (from right to left). Again, this backward (i.e., right to left) movement of the sheet 26 is brought about by rotating rollers 70 and 72 in their respective opposite directions from those depicted in FIG. 1(*b*). In effect, most of the sheet shown in FIG. 2(*b*) re-enters the printer via the same opening 16 through which most of the sheet exited the printer. Thus, the sheet exit opening 16 is capable of serving as a sheet entry opening while the printer is operating in its duplex printing mode.

Those skilled in this art will appreciate that rollers 58B and 58C of the sheet pickup mechanism 58 must also reverse their direction of rotation in order to move the sheet in direction 79 (i.e., from right to left). That is to say that rear roller 58 rotates in the counterclockwise direction suggested by direction arrow 81. Consequently, the direction of rollers 58B and 58C will be the reverse direction from the direction in which they rotate while the pick up mechanism 58 is in its first operating position wherein the axle of the roller 58B is lowered to a level 88 such that the belt 58A is placed in contact with a given top sheet 26 to be taken from stack 24. In effect, these direction changes in rollers 70 and 72 cause the trailing edge 78B of the sheet 26 to become the sheet's "leading edge" when it moves backward (i.e., from right to left). In FIG. 2(*b*) the now leading edge 78B of the backwardly moving sheet 26 has collided with the sheet directing surface 80 of the sheet diverter 76. In order to present the sheet directing surface 80 to the now leading edge 78B of the sheet 26, the diverter 76 is moved to its second operating position (i.e., it has been pivoted in a counterclockwise direction about its pivot device 76A).

Through use of sheet handling devices (such as sheet guide 82), the sheet 26 is then directed into contact with the sheet pickup mechanism 58. For example, the sheet 26 is shown gripped between (1) the portion of the belt 58A passing over the sheet pickup mechanism's rearward pickup roller 58C and (2) a nip roller 84. Again, the sheet pickup mechanism 58 shown in FIG. 2(*b*) is comprised of a belt 58A, a forward pickup roller 58B and a rearward pickup roller 58C. In effect the sheet 26 is first nipped by rollers 58C and 84 and then carried horizontally leftward by the belt 58A from a position defined by the nip of rear roller 58C and roller 84 to a position defined by a nip between the portion of the belt 58A near front roller 58B and roller 92. Again, the pickup mechanism 58 is depicted in FIG. 2(*a*) (through use of solid lines 58A and 58A' that depict a belt passing over forward pickup roller 58B and rearward pickup roller 58C) in its second operating position and (alternatively) in its first operating position. In this second operating position the axle of the pickup mechanism's rearward pickup roller 58C and the axle of its forward pickup roller 58B are shown positioned on substantially the same horizontal level 86.

In FIG. 2(*b*), the pickup mechanism's first operating position is shown in dotted lines. In this first operating position, the axle of the forward pickup roller 58B has moved to a lower horizontal level 88 so that the belt 58A can contact a given top sheet in the stack of sheets 24 in the sheet dispensing tray 22. When the rollers 58B and 58C rotate in the appropriate direction (clockwise) the top sheet is urged forward into media path 28A. Thus, this printer may be operated in a simplex printing mode or a duplex printing mode. In any case, the first operating position of the pickup mechanism 58 is such that a given top sheet can be urged from stack 24, delivered to the printing device 30 and then sent to collection tray 34 to a duplexing printing path. In either case, the belt/roller pickup mechanism 58 can serve a dual function. In its first operating position, it serves as a pickup device for removing a given sheet of print media from a sheet dispensing tray. In this first operating position, the drive roller (e.g., roller 58C) rotates in a clockwise direction. In its second operating position the belt serves as a part of media path through the printer that serves to carry out a duplex printing operation. In this second operating position, the drive roller (e.g., roller 58C) rotates in a counterclockwise direction.

FIG. 2(*b*), for example, shows the sheet 26 being carried by belt 58A in a leftward direction 79. Eventually it passes through an interface between the forward pickup roller 58B and nip roller 92. After passing to the left of the forward pickup roller 58B/nip roller 92 interface, the sheet 26 is directed upward (e.g., by the guide plates 42 and 44 shown in FIG. 1(*a*)) into guide rollers 38 and 40 over the remainder of the first part 28A of the overall media path. In effect, the sheet is turned over while traveling over media path 28A. Thus, the now top side 26B of the sheet (that was formerly the bottom side of the sheet in FIG. 2(*a*)) is able to receive printing from the printer device 30. The sheet 26 then undergoes a duplex printing operation such that both sides 26A and 26B of the sheet receive printing.

FIG. 2(*c*) shows the now turned over sheet 26 being carried over the first part 28A and second part 28B of the overall medial path toward the exit and/or entry opening 16. Since such a sheet will have received printing on both of its sides (26A and 26B) it will then be deposited as a finished product in the sheet collection tray 34. In order to accommodate this, the sheet diverter 76 is shown moved back to its first operating position i.e., by rotating said diverter clockwise about its pivot device 76A.

Figure 3A:
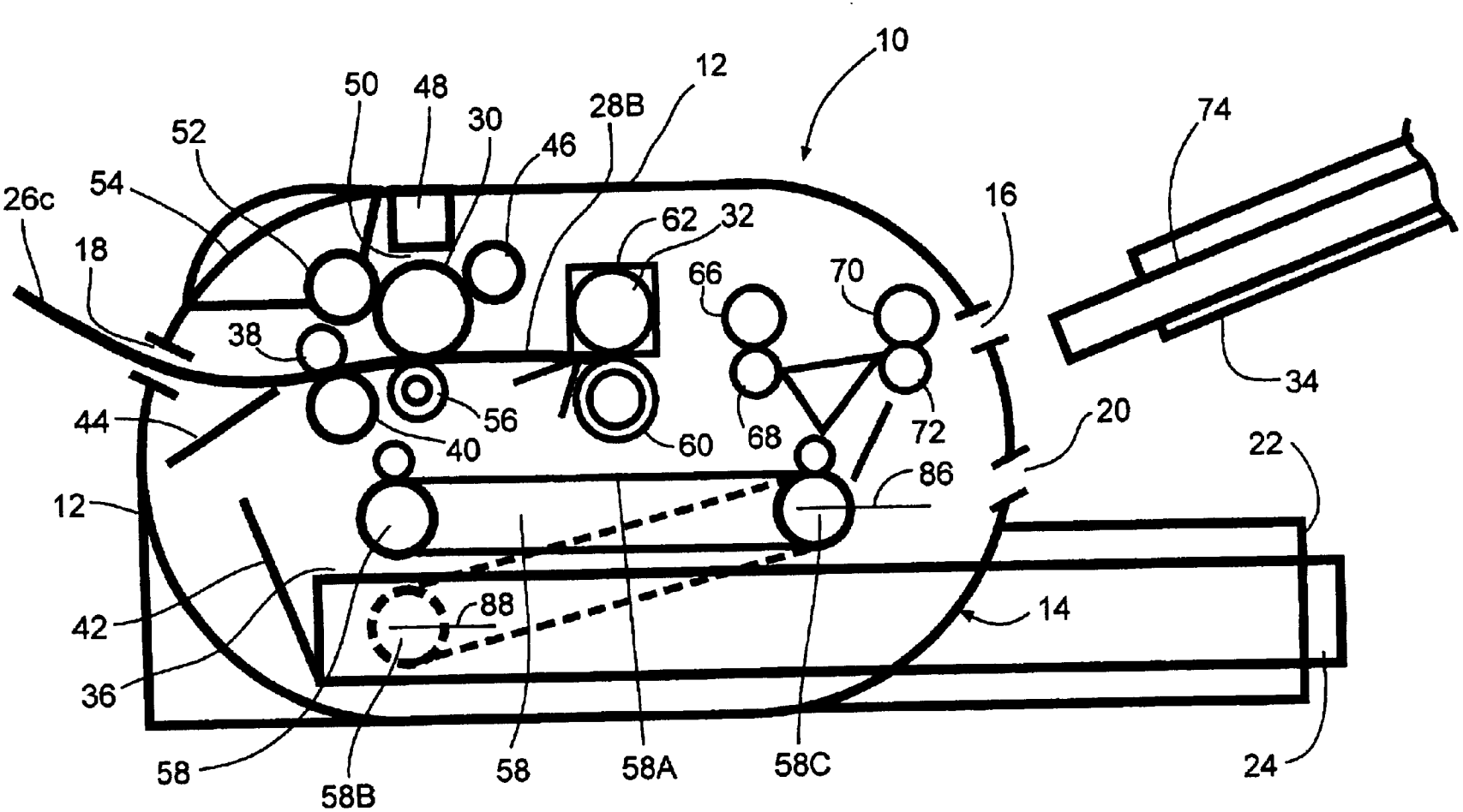
FIG. 3(*a*) shows an embodiment of a printer such as that depicted in FIG. 1(*a*) wherein a sheet of print media has been introduced into said printer via a second sheet entry opening and is shown passing through the printer and fuser.
Figure 3B:
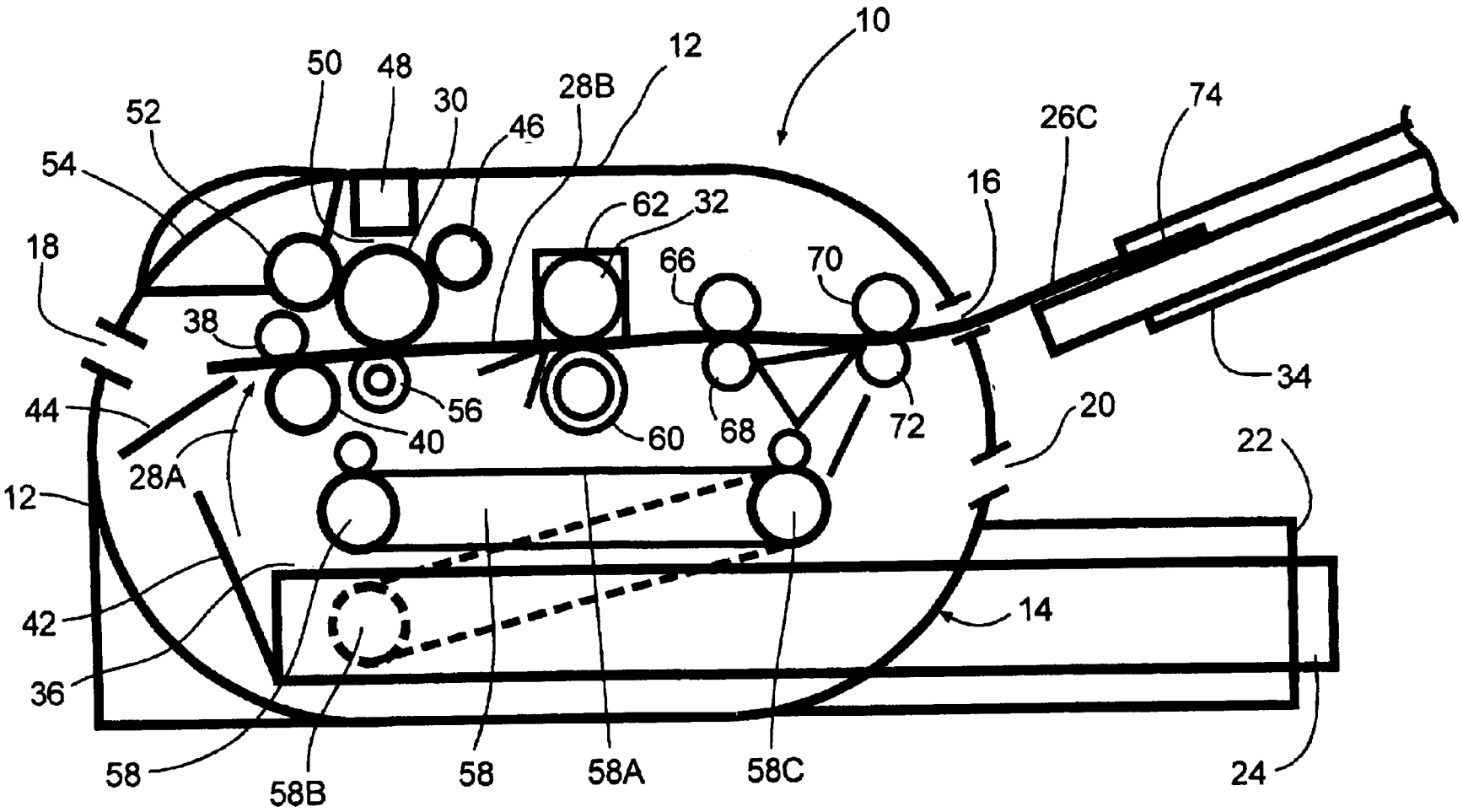

FIG. 3(*a*) depicts another sheet of print media 26C being inserted into a second sheet entry opening 18. Thereafter, the sheet 26C is fed into the interface between guide rollers 38 and 40. This sheet insertion operation can be done manually or by a sheet feeding mechanism (not shown in FIG. 3(*a*)). After passing the guide roller system 38/40, the sheet enters the print zone between the printer device 30 and the transfer roller 56. The sheet 26 then travels over the second part 28B of the overall media path and into the sheet collection tray 34. In this embodiment the second sheet entry opening 18, the printer device 30 and the sheet exit and/or entry opening 16 are on substantially the same horizontal plane. Consequently, a sheet traveling through these three elements is not bent to any substantial degree (e.g., it is not bent more than about 30°).

By way of further example of this printing mode, FIG. 3(*b*) shows the sheet 26C that was depicted in FIG. 3(*a*) passing through (1) the fuser 32, (2) the roller 66/roller 68 interface, (3) the roller 70/roller 72 interface and (4) the exit/entry opening 16, and on into the collection tray 34. In traveling this path, a given sheet is not bent to any great degree (e.g., it is not bent more than about 30°). Hence, use of the printing mode depicted in FIG. 3(*b*) is especially useful in those cases where the print media 26 is not a flexible sheet of paper, but rather a relatively heavy, inflexible print media material such as cardboard or a relatively stiff plastic material. A given sheet may be introduced into sheet receiving opening 18 from a sheet dispensing device (not shown), or by hand.

Figure 4A:
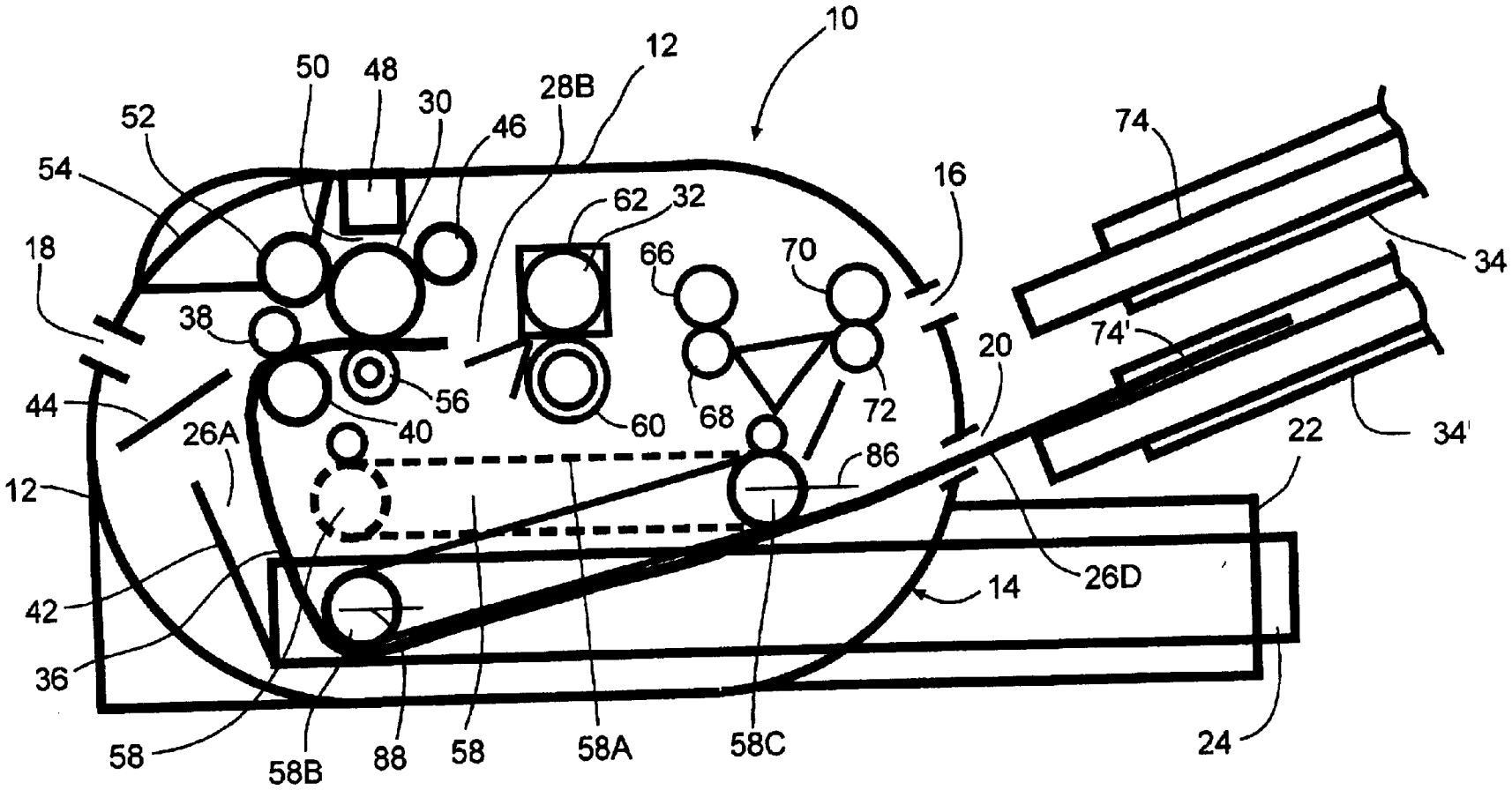
FIG. 4(*a*) is a cross section view of an embodiment of a printer such as the one depicted in FIG. 1(*a*) wherein a sheet is shown entering the printer via a third sheet entry opening in the printer housing.
Figure 4B:
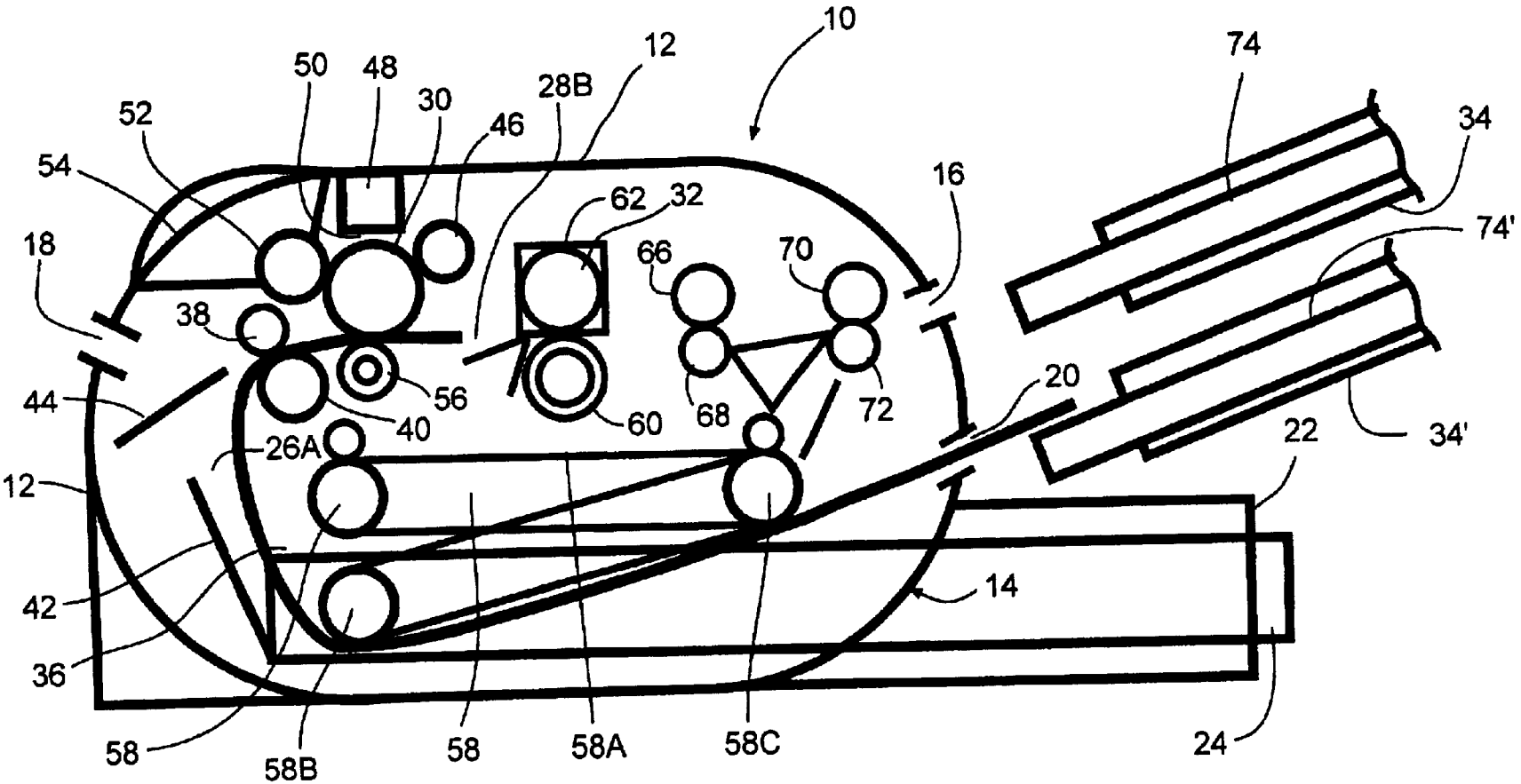
Figure 4C:
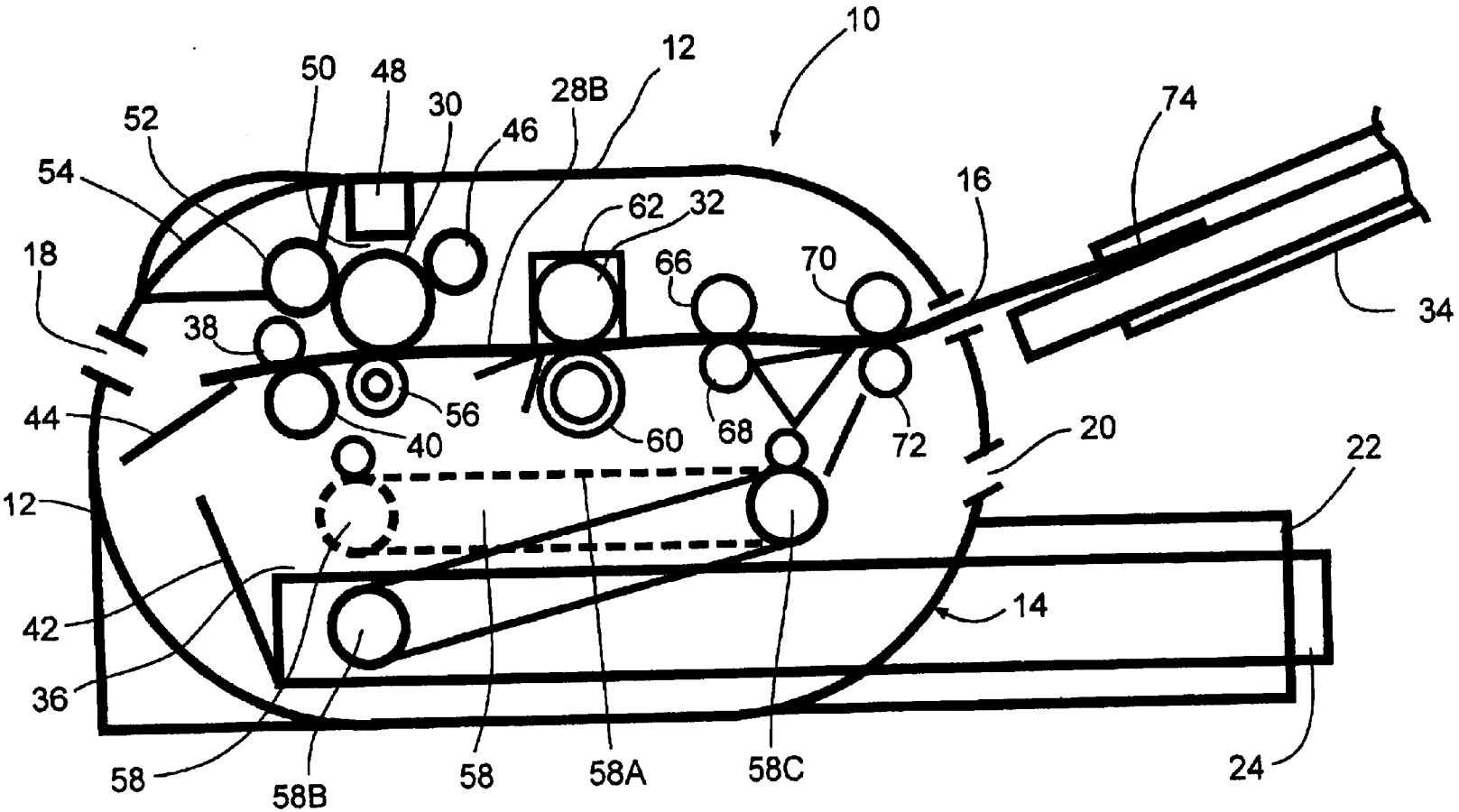

FIG. 4(*a*) depicts a sheet of print media 26D being inserted into the printer 10 via a third sheet entry opening 20. This sheet insertion through sheet entry opening 20 can be through use of a sheet feed tray mechanism 34', or by hand. Thereafter, such a sheet 26D is moved to the left by the sheet pickup mechanism 58 when it is in its first operating position (i.e., when the axle of its forward pickup roller 58B is in its lower operating position 88). It should be noted that a sheet introduced into the printer 10 via the third opening 20 will automatically become the "top" sheet in the stack 24—if such a stack is resting in the sheet dispenser tray 22. Note also that such a top sheet 26D passes under the powered belt 58A. FIGS. 4(*b*) and 4(*c*) depict how such a sheet 26D is further guided (by sheet guides 42, 44, etc. and guide rollers 38 and 40) to the printer 30 in the same general manner as the sheet 26 depicted in FIG. 1(*a*).

Figure 5A:
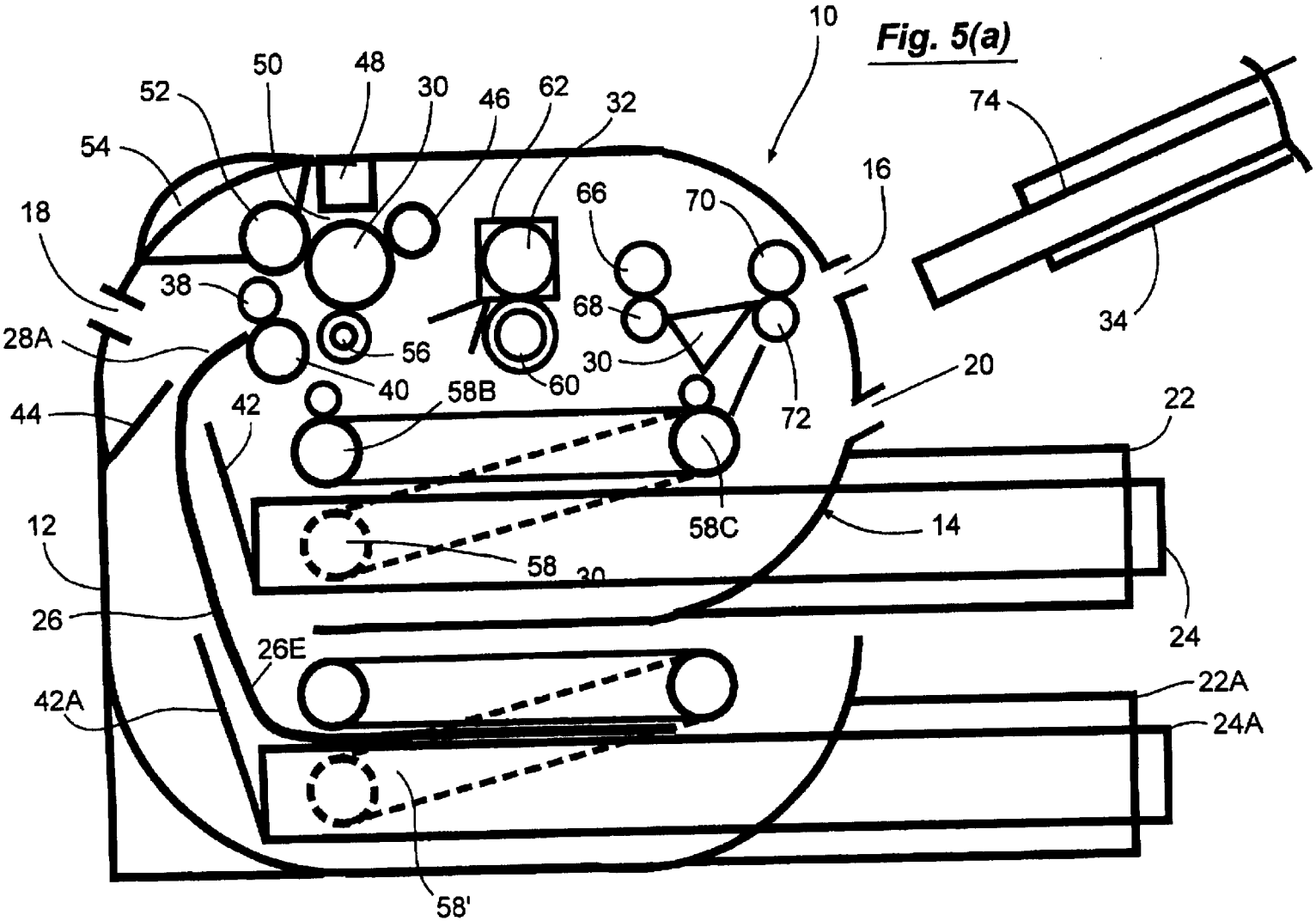
FIG. 5(*a*) shows a cross section view of an embodiment of a printer provided with a second sheet dispensing tray from which a sheet is being taken and directed into the first forwardly moving sheet transport path.
Figure 5B:
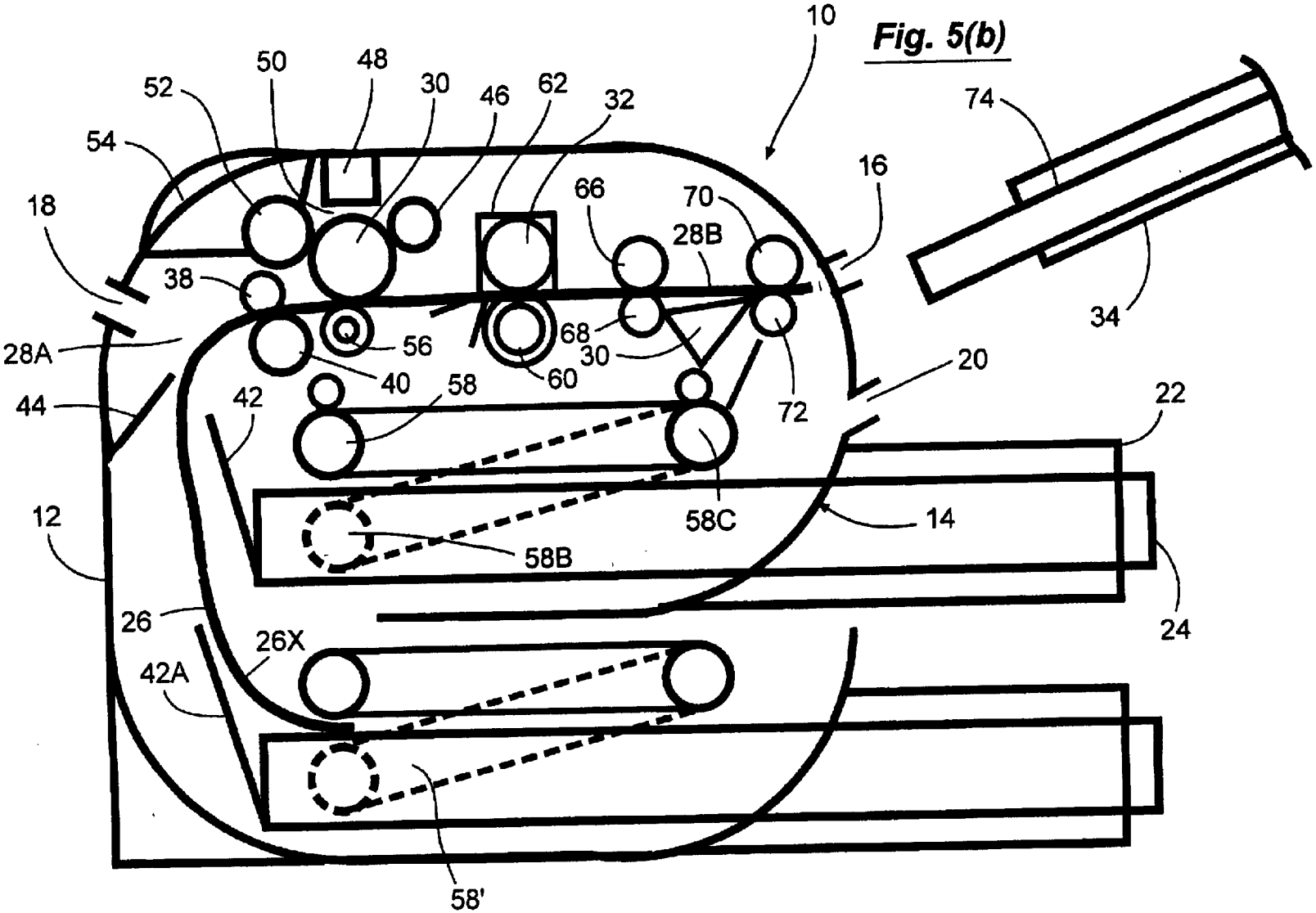
Figure 5C:
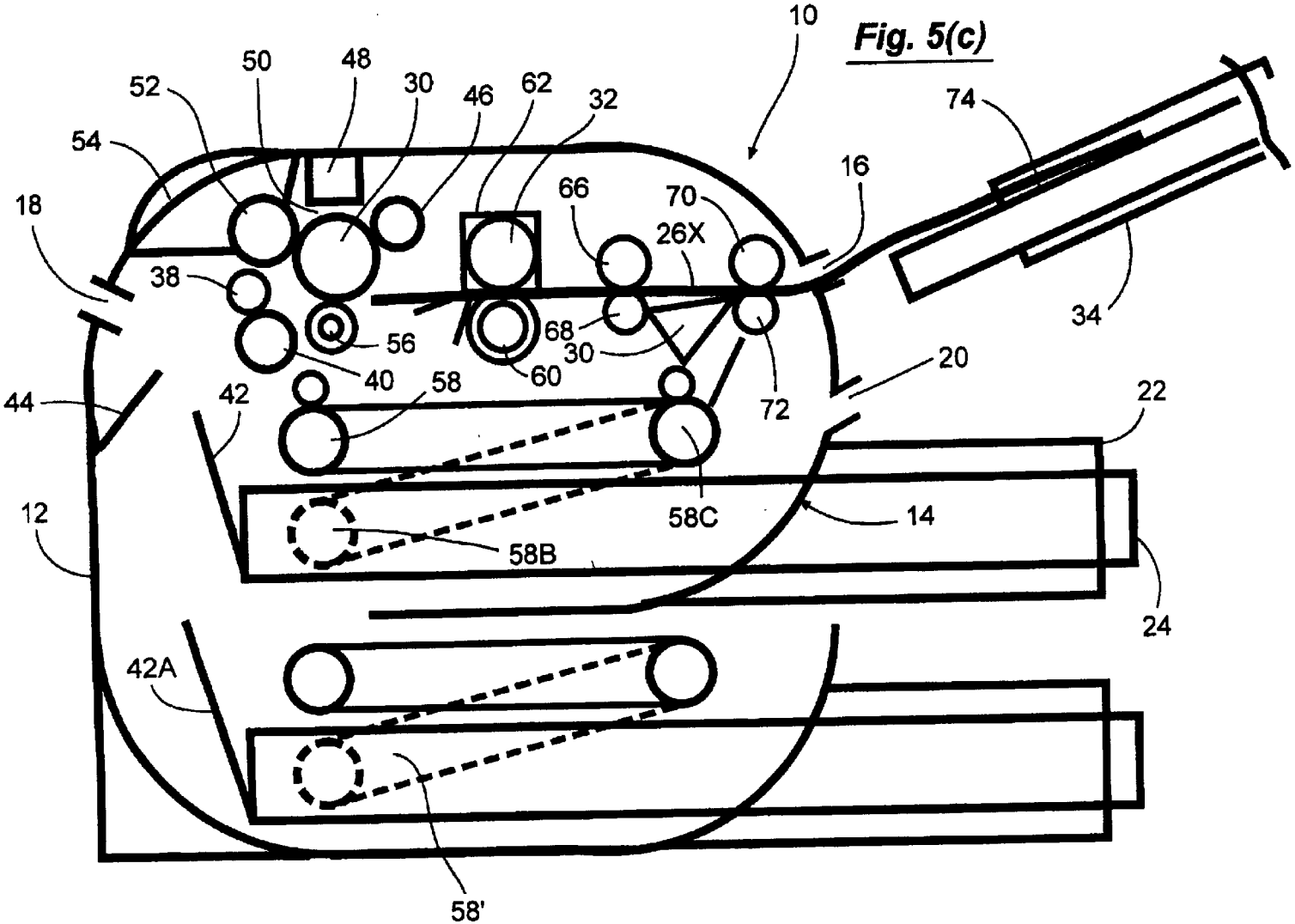

FIG. 5(*a*) depicts a cross section view of a multipath, electrophotographic printer that is provided with two sheet dispensing trays 22 and 22A. Preferably each of the two sheet dispensing trays 22 and 22A are serviced by separate and distinct pickup mechanisms 58 and 58' as depicted in FIGS. 5(*a*), 5(*b*) and 5(*c*). In another embodiment of this invention, the second sheet dispensing tray 22A can be used to dispense a second kind of print media. In FIG. 5(*a*), a given top sheet 26E of such a second kind of print media is shown being removed from a stack 24A of print media in the second dispensing tray 22A. This sheet 26E is guided toward the first part 28A of the overall media path by a sheet guide 42A. FIGS. 5(*b*) and 5(*c*) show the sheet 26 depicted in FIG. 5(*a*) being further directed over the first part 28A and second part 28B of the overall media path and on into sheet collection tray 34. Again, such a sheet 26E may be the same kind, or of a different kind of print media as that dispensed from sheet dispensing tray 22.

Although specific embodiments of this invention have been disclosed herein in detail, it is to be understood that this was for purposes of illustration. Thus, this patent disclosure is not to be construed as limiting the scope of the invention since the described electrophotographic printer and printing methods may be changed in several details by those skilled in the art in order to adapt these printers to particular applications without departing from the scope of the following claims and equivalents of the claimed elements.

Thus, having disclosed this invention, what is claimed is:

1. A printer having a plurality of print media paths therethrough, said printer further comprising:

(1) a printer device;

(2) a first print media path that carries a sheet of print media from a sheet pickup mechanism to the printer device;

(3) a second print media path that carries the sheet from the printer device to at least one sheet exit opening;

(4) a third print media path that carries the sheet from the sheet exit opening back to the printer device;

(5) a housing having:

(a) at least one sheet entry opening through which a sheet can be delivered to the first print media path, and (b) the at least one sheet exit opening through which the sheet can be dispensed from the housing after said sheet travels, in a first flow direction, past the printer device and a sheet diverter;

(6) the sheet diverter having a first operating position for allowing the sheet to pass, in the first flow direction, and a second operating position for diverting the sheet while said sheet travels in a second flow direction toward the printer device; and (7) the sheet pickup mechanism having a first operating position wherein said sheet pickup mechanism picks up the sheet from a sheet dispensing tray, and a second operating position wherein said sheet pickup mechanism serves as a part of a duplex printing path when the sheet travels in the second flow direction toward the printer device, wherein the sheet pickup mechanism comprises a belt and roller mechanism having a first operating position wherein the belt drives a sheet toward the printer device and a second operating position wherein said belt carries an individual sheet over a part of a duplex printing path.

2. An electrophotographic printer having a plurality of print media paths therethrough, said electrophotographic printer further comprising:

(1) an electrophotographic printer device;

(2) a first print media path that carries a sheet of print media from a sheet dispenser tray to the electrophotographic printer device;

(3) a second print media path that carries the sheet of print media from the electrophotographic printer device to a sheet exit opening;

(4) a third print media path that carries the sheet from the sheet exit opening back to the electrophotographic printer device;

(5) a housing having:

(a) a first sheet entry opening through which a sheet of print media can be delivered from a sheet dispensing tray to the electrophotographic printer device, (b) the sheet exit opening for (1) dispensing the sheet of print media from the housing after said sheet travels past a pivotally mounted sheet diverter in a first flow direction, and (2) permitting the sheet to pass back through the sheet exit opening in a second flow direction in order to collide with, and be diverted by said pivotally mounted sheet diverter toward the electrophotographic printer device, (c) a second sheet entry opening through which a sheet can be delivered to the printer device and exit opening at a level such that the sheet does not undergo a bending angle of more than about 30° and (d) a third sheet entry opening through which a sheet can be delivered to the sheet dispensing tray;

(6) the pivotally mounted sheet diverter having (1) a first operating position that allows the sheet to pass through the sheet exit opening when said sheet is traveling in the first flow direction and (2) a second operating position for causing the pivotally mounted sheet diverter to direct the sheet toward the electrophotographic printer device as it travels in the second flow direction; and (7) a belt and roller sheet pickup mechanism having a belt that passes over two rollers and having a first operating position wherein said belt drives the sheet toward the printer device and a second operating position wherein said belt carries the sheet over a portion of a sheet transport path used in a duplex printing operation.

3. The printer of claim 2 wherein the pivotally mounted sheet diverter employs a pivot device to present a surface that guides a leading edge of a sheet traveling in the second flow direction toward the electrophotographic printer device.

4. The printer of claim 2 further comprising the belt and roller sheet pickup mechanism that, in a first operating position, removes a top sheet from a stack of sheets in a sheet dispensing tray positioned adjacent to a first portion of a sheet flow path such that a first side of said sheet receives printing from the printer device and, in a second operating position, serves as a portion of a print media path that serves to turn over the sheet in order to receive printing on its second side.

5. The printer of claim 2 further comprising a first sheet dispensing tray that is serviced by the sheet pickup mechanism.

6. The printer of claim 2 further comprising a second sheet dispensing trays that is serviced by a separate and distinct sheet pickup mechanism.

7. The printer of claim 2 further comprising a sheet collection tray that services the sheet exit opening after a sheet receives simplex printing and after a sheet receives duplex printing.

8. The printer of claim 2 wherein a second sheet entry opening, the printer device and the sheet exit opening are on substantially the same horizontal plane such that a sheet passing over said horizontal plane is not bent more than about 30°.

9. A method for increasing the versatility of a printer, said method comprising:

(1) locating a printer device in a printer housing;

(2) providing a plurality of media paths that pass through the printer housing and printer device;

(3) providing at least one sheet entry opening through which a sheet can be delivered to the printer device;

(4) providing the housing with at least one sheet exit opening for (1) dispensing a sheet from the housing when said sheet travels past a sheet diverter in a first flow direction, and (2) permitting a sheet to travel past the sheet diverter in a second flow direction leading back toward the printer device;

(5) positioning the sheet diverter in the housing such that, while in a first operating position, the sheet diverter can facilitate passage of the sheet out of the at least one sheet exit opening and such that, while in a second operating position, the sheet diverter can direct the sheet in a second flow direction toward the printer device; and (6) positioning a sheet pickup mechanism in the housing such that, in a first operating position, said sheet pickup mechanism drives a sheet toward the printer device and such that, in a second operating position, said sheet pickup mechanism serves as a part of a duplex printing path through the printer, wherein a sheet receives printing on a first side and then is driven in a second flow direction in order to collide with, and be directed by the sheet diverter to the sheet pickup mechanism, which is a belt and roller sheet pickup mechanism in a manner such that said sheet can receive printing on its second side.

* * * * *